US005482809A

United States Patent [19]

Rao et al.

[11] Patent Number: 5,482,809

[45] Date of Patent: Jan. 9, 1996

[54] LIQUID TONERS FROM SOLUBLE POLYMERIC DISPERSANTS WITH REACTIVE GROUPS

[75] Inventors: S. Prabhakara Rao, Ramsey; Valdis Mikelsons, Mendota Heights, both of Minn.

[73] Assignee: Minnesota Mining and Manufacturing Company, St. Paul, Minn.

[21] Appl. No.: 260,696

[22] Filed: Jun. 16, 1994

[51] Int. Cl.[6] ..... G03G 9/13

[52] U.S. Cl. ..... 430/114; 430/115

[58] Field of Search ..... 430/114, 115

[56] References Cited

U.S. PATENT DOCUMENTS

| | | | |
|---|---|---|---|
| 4,144,184 | 3/1979 | Takahata et al. | 252/62.2 L |
| 4,564,574 | 1/1986 | Uytterhoeven et al. | 430/115 |
| 4,758,492 | 7/1988 | Nair | 430/114 |
| 4,762,764 | 8/1988 | Ng et al. | 430/115 |
| 4,978,598 | 12/1990 | Elmasry et al. | 430/137 |
| 4,988,602 | 1/1991 | Jongewaard et al. | 430/115 |
| 5,061,591 | 10/1991 | Nakanishi et al. | 430/159 |
| 5,283,148 | 2/1994 | Rao | 430/114 |

FOREIGN PATENT DOCUMENTS

| | | | |
|---|---|---|---|
| 0437073A2 | 7/1991 | European Pat. Off. | G03G 5/02 |
| 1-237559 | 9/1989 | Japan | G03G 0/08 |

*Primary Examiner*—John Goodrow

*Attorney, Agent, or Firm*—Gary L. Griswold; Walter N. Kirn; Mark A. Litman

[57] ABSTRACT

A liquid toner composition for use in electrographic imaging comprises a non-aqueous solvent and a soluble dispersant made from thermodynamically compatible polymers containing functional groups with good adsorption properties for cyan, magenta, yellow and black pigments. The invention also describes the incorporation of reactive functional groups that crosslink on heat treatment to improve modulus and scratch resistance.

53 Claims, No Drawings

LIQUID TONERS FROM SOLUBLE POLYMERIC DISPERSANTS WITH REACTIVE GROUPS

FIELD OF THE INVENTION

The invention relates to the use of liquid toners to develop a latent electrostatic image produced by addressing an imaging surface, normally a dielectric material, with static electric charge. The liquid toner of this invention may be used with full color large images produced in one pass through an electrographic printer and subsequently transferred to a final receptor sheet.

BACKGROUND OF THE INVENTION

Liquid toners that use amphipathic particles called organosols are described in U.S. Pat. No. 3,753,760, U.S. Pat. No. 3,900,412, U.S. Pat. No. 3,991,226, U.S. Pat. No. 4,988,602, an U.S. Pat. No. 4,978,598. The preferred binder polymers within the toners of these patents comprise a thermoplastic resinous core that is chemically linked to an amphipathic steric stabilizer. The steric stabilizer contains covalently attached groups of a coordinating compound which groups are capable of complexing organometallic charge directing compounds at the metal ion site, and a thermoplastic ester resin that functions as a charge enhancing component.

The above process of formulating toner dispersions is the most widely used in the art. The multicomponent polymer which binds the pigment particles is synthesized in stages in which the core of the latex particle and the outer shell which provides the sterically stabilizing, hydrocarbon (Isopar solvent)—soluble chains after separate synthesis are joined by a chemical reaction. Mutually incompatible, multicomponent polymer units or segments are thus held together in the form of insoluble, chemically bonded entities. Attempts to synthesize the multicomponent polymer systems in a single polymerization step would result in composition heterogeneity and precipitation.

The use of Isopar-soluble polymers such as lauryl methacrylate is disclosed in U.S. Pat. No. 4,690,881 and the use of isobornyl (meth)acrylate is cited in J01237559. The former provides the soft segments and the latter the hard segments. No heavy metal complexing agent is described in these patent publications. The use of charge directing components in the form of complexing, coordinating or chelating moieties are described in separate, totally unrelated patents numbered U.S. Pat. No. 4,758,492 and U.S. Pat. No. 4,564,574.

SUMMARY OF THE INVENTION

The present invention describes toner systems in hydrocarbon solvents especially aliphatic hydrocarbons such as Isopar solvents, the toner formed by the adsorption of soluble polymers onto pigment surfaces. The toner polymeric resin is comprised of >70% by weight of a random copolymer of isopar soluble acrylates, laurel(meth)acrylate and isobornyl(meth)acrylate, and <30% by weight of from 3 to 5 different isopar insoluble monomers, which yields a polymer which is still soluble in the isopar solvent. The toner particle is formed by the adsorption of such a polymer onto a pigment. The soluble polymers also contain 0.25–9.0%, preferably 1–5 weight percent of a chelating monomer copolymerized so that a positively charged metal ion could be complexed to impart a positive charge to the toner particle. This invention incorporates the following features all in a single polymer system: a) polymer segments which are thermodynamically compatible with the other polymer segments so that no phase separation occurs, b) a ratio of soft to hard segments to obtain a 10°–60° C. range of Tg, c) functional group monomers capable of reacting with the polymer or groups pendant from the polymer which are able to crosslink the polymer at temperatures greater than 80° C., d) aliphatic hydrocarbon (e.g. Isopar™) solubility and e) chelating units to complex charging agents. Some examples described in this invention have polymer systems incorporating all the said features except one feature such as c), and some incorporate all the features a)–e) in a single binder/pigment system.

The present invention, while simplifying the resin synthesis to a single step, also provides for the polymer solubility in hydrocarbon solvents, including aliphatic hydrocarbon solvents including isoparaffinic hydrocarbons such as non-polar Isopar™ solvents (Isopar™ G, K, L and M) and the inclusion of functional groups. These features provide stronger adsorption of the polymer onto the pigment surface. It is well known that polymers in good solvents have stronger adsorption to solid surfaces (Scheutjens, J.M.H.M and Fleer, G. J., "The Effect of Polymer on Dispersion Properties," Th. F. Tadros, (Ed.) Academic Press, London (1982); Schetjens, J.M.H.M. and Fleers, G. J., *Adv. Colloid Interface Sci.*, 16,341 (1982) and "T. Tadros, Polymer colloids," Ed. R. Buscall, T. Comer and J. F. Stagemen, Ch. 4, *Adsorption from Solution*—Part II, Elsevier, (1985)).

The adsorption is further aided by the functional groups which serve as anchor groups between the pigment surface and the resin. Another advantage of this invention is the formation of physically homogeneous films of toner images capable of high cohesive strength. Functional reactive groups, which may be present in each of the adjacent overprinted layers, react to further enhance the adhesion and toughness of adjacent layers. The heat activated reaction forms both inter- and intra- layer crosslinks, thereby toughening the entire image. The implication of this in overprinted toner layers is the reduced probability of image loss and splitting during the image transfer from the imaging sheet to the receptor sheet. The interacting functional groups provide interlayer interaction between the overprinted layers during the transfer step to the receptor under conditions of temperatures greater than 80° C., thus providing scratch resistance, toughness or overall improved film modulus to the imaged layer. Reactive groups including carboxyl, hydroxyl, epoxy and the like in the polymeric binders in adjacent overprinted layers react upon thermal activation. An example is where one layer contains pendant —OH functionalities which can react with an overprinted layer containing —COOH pendant groups. Such interacting functional groups are also provided by the pendant O-t-butyl allyl peroxycarbonate groups which are known from independent studies to crosslink above 140° C. (K. Redford, SG. Bond, J. E. Roots and A. Ryningen, Report No: 890204, Jul. 17, 1990, (ISBN No: 82-411-0238-0) in "Studies on PVC Containing Pendant Peroxide Groups" presented at the IUPAC Macromolecular Symposium, Jul. 8–13, 1990, Montreal, Canada.) Preparations of resins consisting of varied ratio of soft and hard segments produce a range of glass transition temperatures, Tg (10°–60° C.). The range can be broadened from −20° to 80° C., if necessary, without any significant changes in this invention.

Liquid toners with pigments of cyan, yellow, magenta and black, as well as non-traditional or tailored colors such as metallics or fluorescents incorporating all the foregoing physico-chemical properties have been or readily can be successfully prepared.

DETAILED DESCRIPTION OF THE INVENTION

The present invention relates to liquid toner compositions for the development of electrostatic images, the toner comprising a colorant and a copolymeric (multimonomeric) random polymer binder which said binder incorporates all the following features in a single resin:

a) thermodynamic compatibility and Isopar solubility (for example, achieved by the incorporation of segments of poly(lauryl methacrylate) and/or poly(lauryl acrylate) (or other longer chain alkyl-type acrylates such as C8 to C20 carbon atom acrylates) and poly(isobornyl acrylate) or poly-(isobornyl methacrylate) whose solubility parameters (δ) are 7.9 and 7.8 (cal. $cm^{-3})^{0.5}$ respectively, their total weight constituting greater than 70% by weight of the chain. Each homopolymer of the said segments is completely soluble in Isopar (δ=7.2) and so are the copolymers of any weight ratio of the said units. Additionally, up to 30% by weight of isopar-insoluble monomers selected from a wide range of free-radically polymerizable monomers can be incorporated into the random copolymer, still obtaining a soluble binder.

b) The variation of the weight ratio of the soft segments of e.g., poly(lauryl methacrylate, Tg=–65° C.) and the hard segments of poly (isobornyl acrylate, Tg=94° C.) provides the desired glass transition temperature in the range of 10°–80° C.

c) Such a polymer chain as described by a) and b) being highly soluble in Isopar, also may incorporate about 1–5 percent by weight of a copolymerizable moiety which contains a complexing agent such as methoxyhydroxyquinoline methacrylate to provide complexing sites for the heavy metal charge director, such as $Zr^{4+}$, to impart a positive charge on the toner particles.

All the toners described in this invention, incorporate the features a) and b), and optionally c).

d) In addition to the above mentioned features, some of the toners described in this invention incorporate segments of any acrylic or vinyl monomer, a functional group monomer (—OH, — COOH, epoxy, —OCO $CH_3$) or mixtures thereof to prepare Isopar soluble polymers used as binders for the pigment. Cyan, magenta and yellow toner layers formed after imaging and overprinting, each containing a reactive group, different from the other, undergo chemical interaction by virtue of the mutual reactivity of the functional groups during the thermally activated image transfer step to a receptor surface, at temperatures greater than 80° C., thus imparting improved toughness and scratch resistance of the film.

e) In addition to the above mentioned features a), b) and most preferably c) in a single polymer system, some of the toners described in this invention incorporate an additional feature, namely peroxy pendant groups derived from O-t-butyl —O—allylmonoperoxy carbonate units copolymerized in the polymer chain, the peroxy group-containing moieties constituting 4–10 percent by weight of the polymer. The synthesis of the peroxy monomer was modified from the outline described in the literature (K. Redford, SG. Bond, J. E. Roots and A. Ryningen, Report No: 890204, Jul. 17, 1990, (ISBN No: 82- 411-0238-0) in "Studies on PVC Containing Pendant Peroxide Groups" presented at the IUPAC Macromolecular Symposium, Jul. 8–13, 1990, Montreal, Canada.) by adapting the reaction to phase transfer catalysis. The 16-min. half life of the peroxy groups pendant on a polymer chain was shown to be 145° C. and therefore, such a monomer could be polymerized at temperatures of 55° C., with peroxy groups intact. Such peroxy groups also undergo thermal (greater than 80° C.) or photochemical crosslinking and toners described in this invention have the crosslinking property after imaging and film formation.

The combination of compatible polymer systems is not limited to homopolymers or copolymers of only isobornyl acrylate/methacrylate or lauryl methacrylate/acrylate. The following monomers are compatible with poly(isobornyl) (meth)acrylate and could also be used: C8 to C20 alkyl acrylates and methacrylates, styrene, 2-ethylhexyl acrylate, hydroxyethyl acrylate, cyclohexyl acrylate, lauryl acrylate, isodecyl acrylate, 1,6-hexanediol diacrylate, neopentylglycol diacrylate, pentaerythritol triacrylate, trimethylolpropane triacrylate. The following are other acrylic monomers yielding soluble polymers in Isopar G: isobornyl methacrylate ($T_g$=170° C.), dicyclopentenyloxyethyl methacrylate ($T_g$=25°–35 ° C.) and dicyclopentenyloxyethyl acrylate ($T_g$=11°–13° C.).

Reactive liquid toners containing functional groups: —O—O—, —OH, —COOH, and epoxy were prepared and exhibited curing on heat treatment to improve the modulus and scratch resistance of the imaged layer. The specific functional group monomers used as representative examples of the various groups were: O-t-butyl-O-allyhnonoperoxy carbonate, methacrylic acid, hydroxyethyl methacrylate, methoxyhydroxyquinoline methacrylate, glycidyl methacrylate and isocyanoethyl methacrylate. The scratch resistance of the toners containing these reactive groups was significantly higher than control samples that did not have the reactive groups. The toners containing peroxy pendant groups cured on heating above 150° C. to give more scratch resistant films. These —O—O-pendant groups were intact during the process of polymerization of monomer for producing binders resins and subsequent processing with pigments to prepare toners.

Measurement of $T_g$ before and after cure shows significant shift to higher values after cure. Peroxide containing polymers showed a 200–300% increase in storage modulus in the room temperature range especially above the $T_g$, when compared with polymers that do not contain the peroxy groups. The effect would be more significant if the crosslinks were uniformly distributed throughout the matrix instead of being present in a few regions with soft segments surrounding these networks as may be the case of present examples where the peroxy monomer was fed in batches rather than continuously.

The toners were used in a Synergy Colorwriter™ 400 electrostatic printer to test ability to form images on a dielectric paper that has a silicone/urea release layer on its surface. The magenta, cyan and yellow toners formed images that survived the printing process without suffering abrasion damage. Colored images could be overprinted. Optical densities were recorded. Image transfer characteristics were recorded using coated Scotchcal™ receptor sheeting as the receptor. Image transfer efficiency is improved if the glass transition temperature, $T_g$ of the polymer is above 60° C. and the molecular weight $M_w$ is above 50,000.

EXAMPLES

Materials used in the following examples are available from standard commercial sources such as Aldrich Chemical Co. (Milwaukee, Wis.) or Polysciences Inc. (Paul Valley, Pa.) unless otherwise specified.

Multi-component random copolymer dispersants were synthesized through a single step solution polymerization in Isopar™ G using varying amounts of thermodynamically compatible segments of lauryl methacrylate (LMA), isobornyl acrylate (IBA), 3,4-monomethyl styrene (vinyl toluene or VT) and 5-methacryloyloxy methyl 8-hydroxyquinoline methacrylate(HQ). The initiator used is 2,2" azobisisobutyronitrile. The resulting polymers showed clear solutions in Isopar™ G. No phase separations or microgels were observed. This single step polymerization, of course, inherently produced a random copolymer.

The chemical structures of each of these components are shown in Table I. The lauryl methacrylate acts as the soft segment component that aids in coalescing the toner particles to a film. It is also the most soluble component in the carrier liquid. The isobornyl acrylate segment imparts hard segments and this, with the aromatic vinyl toluene, balances the $T_g$ of the resulting polymer to give a cohesively strong and abrasion resistant toner. The film $T_g$ can be varied to the desired values by the composition variations of the monomer mixture that consists of widely varying $T_g$s for the polymerized segments (Polylauryl methacrylate: $T_g$=65° C.; polyisobornyl segments polyisobornyl acrylate $T_g$=94° C.). The segments of the fourth monomer HQ act as sites for electrically charging the polymer coated pigment when a charging agent, such as zirconium undecanoate was added. The pigments cyan, yellow, magenta and black were used to prepare the colored toners, but any desired pigment may be used. Particle size in the dispersion was measured using a Coulter N4 submicron particle analyzer.

It should be noted that the polymers formed are compositionally heterogenous and the properties such as molecular weight, glass transition temperature are therefore those of average composition. The molecular weight heterogeneity is not excessively broad as be seen from GPC chromatogram data.

TABLE I

STRUCTURAL FORMULAE OF MATERIALS USED IN THE EXAMPLES

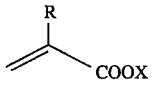

| | | |
|---|---|---|
| $X = (CH_2)_{11}—CH_3$ | $R = CH_3$ | (Lauryl methacrylate) |
| 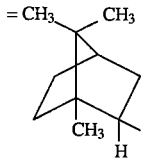 | R = H | (Isobornyl acrylate) |
| 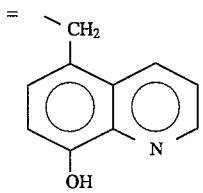 | $R = CH_3$ | (5-Methacryloxymethyl-8-hydroxyquinoline) |
| 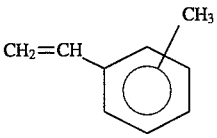 | R = H | (Vinyl toluene) |

TABLE I-continued

STRUCTURAL FORMULAE OF MATERIALS USED IN THE EXAMPLES solvent: Isopar ™ G

Initiator: 2,2' AZOBISISOBUTYRONITRILE, 70° C.

Synthesis of Polymers

Table II lists the polymers prepared, including the quantities of the monomers taken, the amount of solvent, initiator, reaction temperature and time. Examples OS-10 through OS-14 demonstrate that solutions of polymers in Isopar™ G are all clear and no turbidity was observed. Isopar™ G is expected to be a poor solvent for the polymers. The mutual compatibility of polymer segments is evident from the fact that all the solutions are clear, with no phase separation on standing for several weeks.

The indicated quantities of each reactant listed against each polymer are taken in a 3-necked flask of appropriate size fitted with a nitrogen inlet, reflux condenser and thermometer. The liquid monomers (except the HQ, which is solid), are purified by passing through a 15 cm×1.7 cm column of DeHibit-100 (Polysciences Inc., catalog No: 16325), a macroreticular ion exchange resin conditioned to organic systems to reduce the level of polymerization inhibitors to about 1 ppm as claimed by the manufacturer, before use. The reaction mixture was kept stirred by a magnetic stirrer bar and the temperature was maintained at 70° C. unless otherwise noted. An atmosphere of nitrogen was maintained as a blanket throughout the reaction. The initiator was added only after the solid monomer HQ was almost completely dissolved. A second addition of the initiator was made for some preparations at the indicated time shown in Table II. In some cases, the reaction mixture was diluted with the indicated quantity of Isopar™ G solvent after the polymerization was complete. The solid content determination of the reaction mixture indicated a near 100% conversion of the monomers to the polymer. The polymer solutions were used as such to make dispersions.

TABLE II

SYNTHESIS OF DISPERSANTS: MONOMER COMPOSITION & CONDITIONS

| LABEL | COMPOSITION | COMMENTS |
|---|---|---|
| OS-10 | IBA (47.4 g); LMA (39.5 g); HQ (4.74 g); ISOPAR G (290.1 g); AIBN (1.374 g) 36 hrs, 70° C., sec lot AIBN after 12 hrs; last hr 90° C. | 24% solids 100% conversion clear, pale yellowish |
| OS-11 | IBA (120 G); LMA (70 G); VT, mix isomers (20 g); HQ (8.7); ISOPAR G (506 g); AIBN (2.55 g) AIBN see lot after 14 hrs. | |
| OS-12 | IBA (120 g); LMA (20 g); VT mix isomers (20 g); HQ (8.75 g); ISOPAR G (200 g); AIBN (1.0 g) AIBN sec lot after 15 hrs; AIBN (2 g) after 24 hrs. Diluted with ISOPAR G (150 g). | 32 % solids 100% conv clear pale viscous liquid |
| OS-13 | IBA (100 g); LMA (140 g); VT mix isomers (20 g); HQ (8.75 g); same as OS-12. clear, pale | 32% solids 100% conv viscous liq |
| OS-14 | IBA (84 g); LMA (56 g); VT mix isomer (20 g); HQ (8.75 g); same | 30% solids 100% conv. |

TABLE II-continued

| SYNTHESIS OF DISPERSANTS: MONOMER COMPOSITION & CONDITIONS | | |
|---|---|---|
| LABEL | COMPOSITION | COMMENTS |
| | as OS-12 but the ISOPAR G was total of 400 g. | clear pale thin liquid |

Microgels of polymers in any of the polymer samples were found to be absent. All the polymers were soluble in tetrahydrofuran, the solvent used for the gel permeation chromatography analysis of apparent molecular weights.

In all cases, the molecular weight distribution curve from gel permeation chromotography is nearly Gaussian, but with a tail at the low molecular weight end, which invariably broadens the distribution. The molecular weight data is shown in Table III. The stability of dispersions prepared from these polymers was noted by the particle size (300–600 nm) measured in a Coulter submicron particle analyzer (Model N4) and the negligible amount of sediment formed on standing for several days. Traces of sediment, if formed were redispersible on gentle mixing. Observation showed these polymers to be random in configuration.

TABLE III

| MOLECULAR WEIGHT DATA OF DISPERSANTS | | | |
|---|---|---|---|
| POLYMER | $M_w$ | $M_n$ | $M_w/M_n$ |
| OS-10 | 62800 | 4900 | 12.7 |
| Os-11 | 35300 | 4400 | 8.0 |
| OS-12 | 53060 | 5980 | 8.9 |
| OS-13 | 62800 | 5770 | 10.9 |
| OS-14 | 38100 | 4480 | 8.5 |

PREPARATION OF TONER DISPERSIONS

As an example magenta toner of OS-11 is described here. Monastral 796 D magenta pigment (15 gms) was suspended in OS-11 (120 gms). Table IV describes the composition of the different toner formulations. Pigment to resin ratio is 1:2. Suspension was further diluted with Isopar G (120 gms). Zirconium decanoate (6 ml solution of 12% Zr content by weight) was added and mixture was stirred in an Igarashi mill in the presence of 400–450 g of glass beads (1.3 mm diam., Potters) for 100 minutes at 2000 rpm. The toner concentrate was collected and diluted to 1% solids with Isopar™ G to prepare a working strength toner.

TABLE IV

| TONER COMPOSITION AND PROPERTIES | | |
|---|---|---|
| DISPERSANT and $T_g$ in °C. | POLYMER COMPOSITION* | DISPERSION STABILITY |
| OS-10, 14 | IBA/LMA/HQ = 47/40/4/74 | stable |
| OS-11, 02 | IBA/LMA/HQ/VT/HQ = 70/70/20/8.75 | stable |
| OS-12, 62 | IBA/LMA/VT/HQ = 120/20/20/8.75 | stable |
| OS-13, 35 | IBA/LMA/VT/HQ = 100/40/20/8.75 | stable |
| OS-14, 32 | IBA/LMA/VT/HQ = 184/56/20/8.75 | stable |

*Monomer weights in grams carried to ~100% conversion.

Electrical conductivity of this toner was measured when the dispersion had aged for at least 24 hrs. after the addition of the $Zr^{4+}$ charging agent. The particle size in the dispersion was measured in a Coulter N4 Submicron particle analyzer. Table V describes particle size and conductance of the toners prepared in these examples. To test their ability to form images on a dielectric paper with silicone/urea release surface layer, toners were tested in the Synergy Colorwriter™ 400 electrostatic printer (as described in EPO 437,073 AZ issued Jul. 17, 1991). OS-11-Magenta, OS-11-Cyan and OS-10-yellow toners formed images which survived the printing process (paper speed 0.5"/sec) without suffering abrasion damage. Colored images could be overprinted.

The conductivities of the toners ranged from 1.5–9 picomhos/cm and therefore the toner met the electro-static imaging requirements. The particle sizes ranged from 300–600 nm.

Optical densities (OD) obtained on the silicone/urea coated dielectric paper (MT-03) with these toners are listed in Table V.

TABLE V

| OPTICAL DENSITIES OF PRINTED IMAGES ON SILICONE RELEASE LAYER OF DIELECTRIC PAPER* | | |
|---|---|---|
| TONER | OPTICAL DENSITY | COMMENTS |
| OS-11M | 1.08 | good printing and overprinting on cyan, yellow and black |
| OS-11-C | 1.37 | somewhat higher OD. Overprints on all other colors |
| OS-10-Y | 0.99 | somewhat lower OD than desired. |
| S-12-C | 1.39 | higher OD |
| OS-12-M | 1.19 | acceptable OD |
| OS-13-C | 1.18 | acceptable OD |
| OS-13-M | 1.03 | acceptable OD |
| OS-14-C | 1.46 | higher OD |
| OS-14-M | 0.96 | somewhat lower OD |

*$Zr^{4+}$ levels and therefore conductivities were adjusted for the formation of image on the Synergy 400 colorwriter. The OD values therefore, correspond to the adjusted ($Zr^{4+}$).

Image transfer characteristics using the nip roll transfer apparatus was determined using coated Scotchcal™ film as the receptor. Conditions are T >80° C. for 6 sec, 64 psi.

TABLE VI

| POLYMER $T_g$, $M_w$ AND IMAGE TRANSFER EFFICIENCY | | | |
|---|---|---|---|
| TONER | $T_g$ (°C.) | $M_w$ | % TRANSFER |
| OS-11-C | 2 (5*) | 35,300 | 89 |
| OS-11-M | 2 (5*) | 35,300 | 87 |
| OS-10-Y | 14 (8.4*) | 62,800 | 91 |
| OS-14-C | 32 | 38,100 | 86 |
| OS-14-M | 32 | 38,100 | 91 |
| OS-13-C | 35 | 62,800 | 86 |
| OS-13-M | 35 | 62,800 | 92 |
| OS-12-C | 62 | 53,060 | 95 |
| OS-12-M | 62 | 53,060 | 94 |

$T_g$ values are calculated except those marked with * which are measured. Transfer efficiency was determined as described in EPO 437,073 AZ.

Table VI shows the results of the transfer efficiency test. Note that the image transfer efficiency is improved if the glass transition temperature $T_g$ of the polymer is above 60° C., preferably below 30° C. and the molecular weight $M_w$ is above 50,000.

SYNTHESIS OF POLYMERIC DISPERSANTS WITH REACTIVE GROUPS

In addition to the above described polymeric groups reactive functional groups were included in the next examples. Table VII lists the functional groups and tile intended purpose for their addition.

TABLE VII

REACTIVE FUNCTIONAL GROUPS AND PURPOSE

| reactive group | acronym | chemical name | purpose |
|---|---|---|---|
| -0-0- | TBPA | t-butyl-O-allylmonoperoxy carbonate | thermal crosslinker |
| —COOH | MA | methacrylic acid | functional monomer |
| —OH | HEMA, TPA | hydroxyethyl methacrylate, tripropylene glycol diacrylate | functional monomer |
| EPOXY | GMA | glycidyl methacrylate | crosslinker |
| —CH=CH$_2$ | ICM, CMA | isocyanatoethyl MA,cyclopentyl MA | crosslinker |
| uv chromo-phores | MBA | 4-methacryloxy-2-hydroxy-benzophenone | uv absorber |
| | BPA | 1,3 bis(4-benzoyl-3-hydroxyphenoxy-2-propyl acrylate | uv absorber |
| —COOR | VA | vinyl acetate | functional monomer |
| methacry-late | DMS | dimethacryloyl polystyrene | crosslinker |

Table VIII describes the details of polymerization conditions for the inclusion of reactive groups. The ratios of the bulk polymers IBA and LMA were varied to achieve the desired softness.

REACTION CONDITIONS

About 150 gms of the monomer mixture was mixed with 150 gms of Isopar G solvent and polymerization initiated with 2 gms of 2,2'Azobisisobutyronitrile at 70° C. in nitrogen blanket. After about 8 hrs, additional increment of the initiator (2 gms) was added. Polymerization was allowed to continue for another 12–14 hrs. A third increment of initiator, (about 1.5 gms) was added and polymerization stopped after 36 hrs. About 100% conversion, with 33% solids were obtained.

*When TBPA monomer was used, the reaction temperature was never allowed to exceed 55° C. The initiator used was: 2,2' Azobis(2,4 dimethyl valeronitrile), Vazo 52™, 10 hr half life: 52° C. See Table X for the synthesis of O,O-t-butyl-O-allylmonoperoxycarbonate (TBPA).

TABLE IX

SYNTHESIS OF O,O-t-BUTYL-O-ALLYLMONOPEROXYCARBONATE (TBPA)

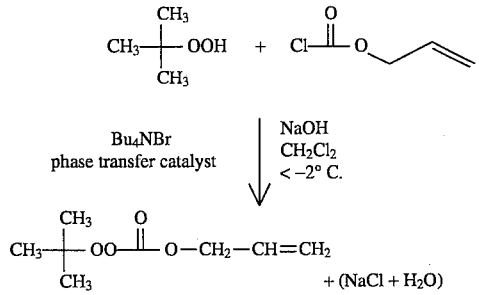

O,O-t-Butyl-O-Allylmonoperoxycarbonate

DECOMPOSITION OF TBPA AT O—O

TABLE VIII

POLYMER DISPERSANTS WITH REACTIVE GROUPS MONOMER COMPOSITION (WEIGHT IN GRAMS)

| ID | IBA | LMA | VT | HQ | MBA | BPA | TPA | TBPA* | HEMA | Other |
|---|---|---|---|---|---|---|---|---|---|---|
| OS-31G | 40 | 85 | 15 | 6 | — | 1 | 1 | — | — | MA |
| OS-32G | 30 | 95 | 15 | 6 | — | 1 | 1 | — | 3 | — |
| OS-33G | 40 | 80 | 15 | 6 | — | 1 | 1 | — | — | VA[a] |
| OS-36G | 40 | 80 | 15 | 6 | — | 1 | 1 | — | — | GMA |
| OS-37 | 40 | 80 | 5 | 6 | 2 | — | 1 | 7 | — | VA, CMA[b] |
| OS-38 | 40 | 80 | 5 | 6 | 2 | — | 1 | — | 10 | VA, IMA[c] |
| OS-39 | 45 | 60 | 30 | 5 | 2 | — | 1 | — | 4 | DMS[d] |
| OS-40 | 45 | 60 | 32 | 5 | 2 | — | 1 | — | 4 | — |
| OS-41 | 50 | 50 | 34 | 5 | 2 | — | 1 | 10 | — | — |
| OS-42 | 50 | 50 | 32 | 6 | 2 | — | 1 | 10 | — | DMS[e] |
| OS-43 | 40 | 60 | 34 | 6 | — | 2 | 1 | 15 | — | — |
| OS- | 30 | 79 | 34 | 6 | — | 2 | 1 | 15 | — | — |

[a]8 gms; [b]8 gms, 5 gms; [c]8 gms, 8 gms; [d]2 gms; [e]2 gms

TABLE IX-continued

SYNTHESIS OF O,O-t-BUTYL-O-ALLYLMONOPEROXYCARBONATE (TBPA)

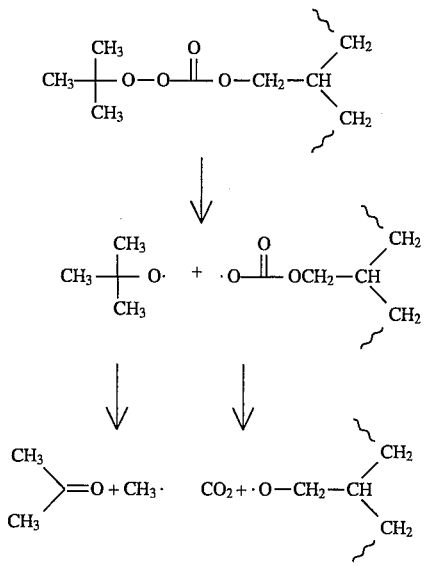

DISCUSSION OF RESULTS OF TABLE VIII

The examples of toners containing pendant peroxide (O—O) groups are OS-37, OS-41, OS-42, OS-43 and OS-44. The toner particles had a pigment: resin ratio of 1:4 for cyan, 1:3 for magenta and 1:5 or 1:6 for the yellow. Table XI shows the conductance and the particle size of the resulting toner formulation.

TABLE X

CONDUCTIVITIES AND PARTICLE SIZE OF SELECTED TONERS USED IN PRINTING IMAGES

| TONER | COLOR | *$ZR^{4+}$ | CONDUCTIVITY $(ohm\ cm)^{-1} \times 10^{11}$ | PARTICLE SIZE nm |
|---|---|---|---|---|
| OS-43 | cyan | 1.2 | 3.79 | 295 ± 100 |
| | magenta | 1.0 | 2.80 | 342 ± 110 |
| | yellow | 1.0 | 3.30 | 382 (narrow) |
| OS-44 | cyan | 2.5 | 3.44 | 317 ± 100 |
| | magenta | 1.0 | 2.94 | 365 ± 100 |
| | yellow | 1.0 | 2.32 | 426 ± 100 |

*milliliters of Zirconium Ten Cem (Mooney Chemical) of 12% $Zr^{4+}$ content added to about 5 liters of toner, 1% concentrate, yielding the indicated conductance shown in the table. These toners were used for printing images.

Particle size reported was determined on a Coulter N4 Submicron particle analyzer. The values were in 95% confidence limits.

Two kinds of heat treatment were given to the images to effect curing by the reactive groups in the toner resins:

1. passing through a heated nip roll (~70°–80° C.) 4 times under air pressure of ~64 psi, and 2. curing in an oven at ~ 160° C. for 30 minutes, when almost complete cure of the peroxide is expected.

SCRATCH RESISTANCE OF TONERS WITH REACTIVE GROUPS

Scratch resistance of toners OS-43 and OS-44 which contains the peroxy groups is significantly higher than the control OS-40, which does not contain peroxy groups. Table XII describes the results is detail.

The literature (Redford et al, see page 3 line 23) predicts that the half life of the peroxide of the monomer used is 16 minutes at 145° C.

Scratch resistance of toners with other reactive groups are described in Table XIII. The effect of overprinting of combinations of toners, each with a reactive functional group such that a reactive group from one layer reacts with the functional group of the layer overprinted on it was examined.

No significant effect is seen for single toners. Increased scratch resistance by virtue of the possible interaction between functional groups were observed. Film properties were measured to follow this effect.

TABLE XI

SCRATCH RESISTANCE OF PEROXY CONTAINING TONERS

| | | NUMBER OF RUBS BY CROCKMETER (AATCC, MODEL CM-5) | | |
|---|---|---|---|---|
| TONER | COLOR | no cure | 4 passes nip roll* at 380° F. | 30 min cure #, 160° C. |
| OS-43 | cyan | 1–2 | 12 | 75 |
| | magenta | 5 | 41 | 82 |
| | yellow | 8 | 63 | 26 |
| OS-44 | cyan | 1 | 11 | 48 |
| | magenta | 2 | 47 | 77 |
| | yellow | 4 | 96 | >284 |
| | orange | 2 | 41 | 60 |
| | green | 2 | 69 | 23 |
| OS-40 (control without peroxy group) | cyan | 2 | 5 | 26 |
| | magenta | | 5 | 136 |
| HILORD @ (unknown comp-osition) | cyan | 1 | — | 62 |
| | magenta | 2 | — | 62 |
| | yellow | 30 | — | >200 |
| | orange | 1 | — | 24 |
| | green | 1 | — | 9 |

The residence time of the film at that temperature is <1 minute. The actual temperature of the film may be ~70°–80° C.; a pressure of 64 psi was applied.

#This is to test the maximum cure possible. Normally these conditions do not apply in actual image treatment.

TABLE XII

SCRATCH TESTS FOR TONERS WITH REACTIVE GROUPS

| | | NUMBER OF RUBS BY CROCKMETER (AATCC, Model CM-5) | |
|---|---|---|---|
| TONER | COLOR | control, no cure | 4 passes nip roll*, 380° F. |
| OS-31G | cyan | 2 | 5 |
| OS-33G | magenta | 4 | 16 |
| 31/33 | overprt. | 3 | 28 |

TABLE XII-continued

SCRATCH TESTS FOR TONERS WITH REACTIVE GROUPS

| TONER | COLOR | NUMBER OF RUBS BY CROCKMETER (AATCC, Model CM-5) control, no cure | 4 passes nip roll*, 380° F. |
|---|---|---|---|
| OS-32G | magenta | 14 | 23 |
| 31/32 | overprt. | 8 | 23 |
| OS-36G | cyan | 3 | 4 |
| 36/33 | overprt. | 2 | 5 |
| OS-40 | cyan | 2 | 5 |

*The actual temperature of the heated film in the nip roll may be in the range ~70–80° C. at the setting described.

There is an improvement in the scratch resistance when toners are overprinted over the resistance of a single colored image; although the overprinting combination 36/33 does not fall in line.

Table XIII describes the reactive groups present in the toner samples shown in Table XII.

TABLE XIII

Explanation of Table XII

| toner | reactive group | comment |
|---|---|---|
| OS-31G | —COOH | no thermal cure |
| OS-33G | —$OCOCH_3$ | some thermal cure |
| 31/33 overprt | —$OCOCH_3$ + COOH | some toughening ~70–80° C., 64 psi |
| OS-32G | —OH | general roughening of film |
| 31/32 overprt | —COOH + —OH | no thermal cure |
| OS-36G | epoxy | weak film |
| 36/33 overprt | epoxy + —$OCOCH_3$ | thermal cure observed only above 150° C. not at 80° C. |
| OS-40 | —OH | no toughening at ~70–80° C., 64 psi |

DYNAMIC MECHANICAL PROPERTIES OF THE CROSSLINKED TONERS $T_g$ values were measured before and after cure. Any contribution to $T_g$ by increase in crystallinity should show in the control sample OS-40 which did not have the crosslinking group. The significant shift to higher values observed accounted for more than that caused by the crystallization, suggesting restricted segmental motion by crosslinking. See Table XIV.

The percentage of increase in the storage modulus, G' after cure showed an increase of 200–300% in the room temperature range, for the peroxide containing polymers. The control sample OS-40 did not show such increase under similar conditions. The increase in the G' above $T_g$ is generally more pronounced than that below the glass transition because of the restricted segmental motion in crosslinked regions.

The effect is expected to be more significant, if the crosslinks were more uniformly distributed throughout the matrix instead of being present in a few regions with soft segments surrounding these networks as may be the case in the present examples where the peroxy monomer was fed in batches rather than continuously.

The measurements were made on a dupont 983 Dynamic Mechanical Analyzer (DMA) with the experimental resins supported on a glass scrim.

Experimental Conditions are the following:

Before cure: First heating cycle of −80° to 140° C. (5 deg/min) with 30 minute hold at 140° C. before cooling.

After cure: After first heating and cooling, a second heating cycle, with conditions same as the first.

TABLE XIV

STORAGE MODULUS (G') AND $T_g$ OF "CROSSLINKABLE" RESINS USED IN TONERS

| TONER | $T_g$, °C. before cure | $T_g$, °C. after cure | TEMP T °C. | G' (GPa) before cure | G' (GPa) after cure | % increase of G' after cure |
|---|---|---|---|---|---|---|
| OS-40 Control | 33 | 33 | 10 | 0.246 | 0.403 | 64 |
| | | | 15 | 0.227 | 0.378 | 66 |
| | | | 20 | 0.205 | 0.344 | 68 |
| | | | 25 | 0.175 | 0.282 | 61 |
| | | | 30 | 0.138 | 0.221 | 60 |
| | | | 35 | 0.076 | 0.144 | 89 |
| | | | 40 | 0.047 | 0.091 | 94 |
| | | | 45 | 0.036 | 0.057 | 58 |
| OS-41 | 18 | 33 | 10 | 1.05 | 2.0 | 90 |
| | | | 15 | 0.78 | 1.8 | 130 |
| | | | 20 | 0.55 | 1.65 | 200 |
| | | | 25 | 0.35 | 1.3 | 270 |
| | | | 30 | 0.25 | 0.78 | 210 |
| OS-43 | 15 | 25 | 10 | 0.516 | 0.851 | 65 |
| | | | 15 | 0.389 | 0.756 | 94 |
| | | | 20 | 0.255 | 0.630 | 147 |
| | | | 25 | 0.148 | 0.446 | 200 |
| | | | 30 | 0.087 | 0.270 | 210 |
| OS-44 | 15 | 20 | 10 | 0.814 | 1.19 | 46 |
| | | | 15 | 0.591 | 1.068 | 80 |
| | | | 20 | 0.370 | 0.804 | 117 |
| | | | 25 | 0.253 | 0.515 | 103 |
| | | | 30 | 0.167 | 0.336 | 101 |

What we claim is:

1. A liquid toner composition for electrostatic imaging comprising a colorant and a polymer that forms clear, single phase solutions with carrier liquid, said polymer derived from at least one monomer selected from the group consisting of isobornyl acrylate and isobornyl methacrylate containing 1 to 5% by weight of said polymer of chelating units, which chelating units complex charge agents.

2. A liquid toner as recited in claim 1 wherein the carrier liquid comprises a hydrocarbon having a boiling point in the range of about 140° to 220° C., resistivity of more than $10^{11}$ ohm-cm and a dielectric constant less than about 3.5.

3. A liquid toner according to claim 1 comprising colorant particles in intimate association with the polymer containing chelating units, said particles having an average diameter between 0.1 micron and 1 micron.

4. A liquid toner in claim 3 wherein said colorant particles are selected from the group consisting of pigments.

5. A liquid toner according to claim 1 wherein said polymer, in addition to having chelating units, is derived from monomers selected from the group consisting of lauryl (meth)acrylate, isobornyl (meth)acrylate, dicylcopentenyl (meth)acrylate, sytrene, 2 ethylhexyl acrylate, hydroxyethyl acrylate, cyclohexyl acrylate, isodecyl acrylate, 1,6 hexanediol diacrylate, neopentylglycol diacrylate, pentaerythritol triacrylate, and trimethylolpropane tricacrylate.

6. A liquid toner according to claim 1 wherein said polymer has a $T_g$ of about 10° C. to 80° C. and a molecular weight, $M_w$ of about 10,000 to 80,000.

7. A liquid toner as recited in claim 2 wherein said polymer comprises a segment having said chelating units derived from monomers chosen from the group consisting of:

$CH_2$=CHR—X where R is H or $CH_3$ and X is chosen from the group consisting of 8-hydroxyquinoline, acetoacetoxyethyl, bipyridyl groups, and 2,2'-bipyrid-4-yl methyl groups.

8. The toner of claim 1 wherein said polymer also contains reactive functionalities which crosslink the polymer upon heating.

9. A liquid toner according to claim 8 wherein the reactive functionalities comprise peroxy, hydroxy, carboxy, epoxy, (meth)acrylates, styrene or vinyl acetate groups.

10. A liquid toner of claim 4 wherein the proportion of polymer to pigment is between 10 to 1 and 1.5 to 1.

11. A liquid toner according to claim 3 comprising a component having at least one ion selected frown the group consisting of $Zr^{IV}$, $Cu^{II}$, $Al^{III}$, $Cr^{III}$, $Fe^{II\ and\ III}$ and $Ti^{IV}$ which are chelated by said chelating units.

12. A liquid toner according to claim 1 comprising colorants selected from the group consisting of carbon black, phthalocyanines and azo dyes.

13. A liquid toner according to claim 1, wherein the combination of monomer units in the binder resin includes at least 70% by weight of isobornyl acrylate and lauryl methacrylate copolymerized in ratios to obtain a Tg of 10° C. to 80° C.

14. A liquid toner according to claim 5 comprising a component having at least one ion selected from the group consisting of $Zr^{IV}$, $Cu^{II}$, $Al^{III}$, $Cr^{III}$, $Fe^{II\ and\ III}$ and $Ti^{IV}$ which are chelated by said chelating units.

15. A liquid toner according to claim 6 comprising a component having at least one ion selected from the group consisting of $Zr^{IV}$, $Cu^{II}$, $Al^{III}$, $Cr^{III}$, $Fe^{II\ and\ III}$ $Ti^{IV}$ which are chelated by said chelating units.

16. A liquid toner according to claim 7 comprising a component having at least one ion selected from the group consisting of $Zr^{IV}$, $Cu^{II}$, $Al^{III}$, $Cr^{III}$, $Fe^{II\ and\ III}$ and $Ti^{IV}$ which are chelated by said chelating units.

17. A liquid toner according to claim 9 comprising a component having at least one ion selected from the group consisting of $Zr^{IV}$, $Cu^{II}$, $Al^{III}$, $Cr^{III}$, $Fe^{II\ and\ III}$ and $Ti^{IV}$ which are chelated by said chelating units.

18. A liquid toner composition for electrostatic imaging comprising a colorant, a carrier liquid, and a polymer that forms clear, single phase solutions with said carrier liquid, said polymer comprising a random copolymer containing chelating units complexing charging agents.

19. The toner of claim 17 wherein said polymer comprises units at least 70% of which were derived from isobornyl acrylate or isobornyl (meth)acrylate.

20. A liquid toner composition for electrostatic imaging comprising a colorant, carrier liquid, and a copolymer that forms clear, single phase solutions with said carrier liquid, said polymer containing chelating units to complex charging agents and copolymer units derived from a) at least one monomer of isobornyl acrylate or isobornyl methacrylate and b) a second monomer of an acrylate or methacrylate different from a).

21. The liquid toner of claim 20 wherein said second monomer comprises lauryl acrylate or lauryl methacrylate.

22. The liquid toner of claim 20 wherein said copolymer comprises a copolymer of isobornyl acrylate and lauryl methacrylate or isobornyl methacrylate and lauryl acrylate.

23. The liquid toner of claim 20 wherein said copolymer comprises 70% by weight of units derived from at least isobornyl acrylate and lauryl methacrylate or at least isobornyl methacrylate and lauryl acrylate.

24. The liquid toner of claim 20 wherein at least 70% by weight of said copolymer is derived from a) isobornyl acrylate or isobornyl methacrylate and b) said second monomer, with both a) and b) present in said copolymer.

25. A liquid toner according to claim 20 comprising colorant particles in intimate association with the polymer containing chelating units, said particles having an average diameter between 0.1 micron and 1 micron.

26. A liquid toner according to claim 20, in which said polymer, in addition to said chelating units and said isobornyl acrylate or isobornyl methacrylate, is derived from monomers selected from the group consisting of lauryl (meth)acrylate, dicylcopentenyl (meth)acrylate, styrene, 2-ethylhexyl acrylate, and cyclohexyl acrylate, isodecyl acrylate.

27. A liquid toner according to claim 20 comprising a charging agent having ions selected from the group consisting of $Zr^{IV}$, $Cu^{II}$, $Al^{III}$, $Cr^{III}$, $Fe^{II}$ and $^{III}$ and $Ti^{IV}$ which are chelated by said chelating units.

28. A liquid toner according to claim 23 comprising a charging agent having ions selected from the group consisting of $Zr^{IV}$, $Cu^{II}$, $Al^{III}$, $Cr^{III}$, $Fe^{II}$ and $^{III}$ and $Ti^{IV}$ which are chelated by said chelating units.

29. A liquid toner according to claim 24 comprising a charging agent having ions selected from the group consisting of $Zr^{IV}$, $Cu^{II}$, $Al^{III}$, $Cr^{III}$, $Fe^{II}$ and $^{III}$ and $Ti^{IV}$ which are chelated by said chelating units.

30. A liquid toner according to claim 25 comprising a charging agent having ions selected from the group consisting of $Zr^{IV}$, $Cu^{II}$, $Al^{III}$, $Cr^{III}$, $Fe^{II}$ and $^{III}$ and $Ti^{IV}$ which are chelated by said chelating units.

31. A liquid toner composition for electrostatic imaging comprising a colorant, a carrier liquid, and a copolymer that forms clear, single phase solutions with said carrier liquid, said copolymer comprising a random copolymer comprised of units derived from a) at least one of isobornyl acrylate and isobornyl methacrylate and b) an acrylate or methacrylate comonomer, said copolymer containing 1 to 5% by weight of said copolymer of chelating units, which chelating units complex charging agents.

32. The toner of claim 31 wherein said polymer comprises units at least 70% of which are derived from isobornyl acrylate or isobornyl (meth)acrylate.

33. A liquid toner composition for electrostatic imaging comprising a colorant, a carrier liquid, and a copolymer that forms a solution with said carrier liquid, said copolymer derived from at least one monomer of isobornyl acrylate.

34. The toner of claim 33 wherein said solution is a clear single phase solution.

35. The toner of claim 34 wherein said copolymer is derived from at least isobornyl acrylate and lauryl methacrylate copolymers.

36. A liquid toner composition for electrostatic imaging comprising a colorant, a carrier, and a copolymer that forms a solution with said carrier liquid, said copolymer derived from at least one monomer of isobornyl methacrylate.

37. The toner of claim 36 wherein said toner is a clear, single phase solution.

38. The toner of claim 37 wherein said copolymer is derived from at least monomers of isobornyl methacrylate and lauryl acrylate.

39. The toner of claim 1 wherein at least one moeity of said polymer is derived from o-t-butyl-o-allylmonoperoxy carbonate.

40. The toner of claim 17 wherein at least one moeity of said copolymer is derived from o-t-butyl-o-allylmonoperoxy carbonate.

41. The toner of claim 20 wherein said at least one moeity of said copolymer is derived from o-t-butyl-o-allyhnonoperoxy carbonate.

42. The toner of claim 32 wherein at least one moeity of said copolymer is derived from o-t-butyl-o-allylmonoperoxy carbonate.

43. The toner of claim 36 wherein at least one moeity of said copolymer is derived from o-t-butyl-o-allylmonoperoxy carbonate.

44. A multicolor liquid electrographically toned image on a substrate comprising at least two layers of overlying liquid toner images, at least one liquid toner image formed from the liquid toner of claim 1.

45. The image on a substrate of claim 44 wherein at least two toner images overlying each other are formed from liquid toners according to claim 1.

46. The image on a substrate of claim 45 wherein components said at least two toner images are reacted across layer boundaries to chemically bind portions of said two toner images to each other.

47. A liquid toner composition for electrostatic imaging comprising a colorant and a polymer in a clear, single phase solution with a parafinnic hydrocarbon liquid carrier, said polymer derived from the group consisting of isobornyl acrylate and isobornyl methacrylate containing 1 to 5% by weight of said polymer of chelating units, which chelating units complex charge agents.

48. The liquid toner of claim 47 wherein said liquid cartier has a boiling point in the range of 140 to 220 degrees Celsius, a resistivity of more than $10^{11}$ ohm-cm, and a dielectric constant less than 3.5.

49. The liquid toner of claim 47 wherein said polymer comprises a copolymer of at least one of isobornyl acrylate and isobornyl methacrylate with at least one of lauryl acrylate and lauryl methacrylate.

50. The liquid toner of claim 47 wherein said polymer comprises a copolymer of either isobornyl acrylate and lauryl methacrylate or isobornyl methacrylate and lauryl acrylate.

51. The liquid toner of claim 47 further comprising a charging agent having ions selected from the group consisting of $Zr^{IV}$, $Cu^{II}$, $Al^{III}$, $Cr^{III}$, $Fe^{II}$ and $Fe^{III}$ and $Ti^{IV}$ which are chelated by said chelating units.

52. The liquid toner of claim 49 further comprising a charging agent having ions selected from the group consisting of $Zr^{IV}$, $Cu^{II}$, $Al^{III}$, $Cr^{III}$, $Fe^{II}$ and $Fe^{III}$ and $Ti^{IV}$ which are chelated by said chelating units.

53. The liquid toner of claim 50 further comprising a charging agent having ions selected from the group consisting of $Zr^{IV}$, $Cu^{II}$, $Al^{III}$, $Cr^{III}$, $Fe^{II}$ and $Fe^{III}$ and $Ti^{IV}$ which are chelated by said chelating units.

* * * * *